United States Patent [19]

Holladay et al.

[11] 4,043,851

[45] Aug. 23, 1977

[54] METHOD AND APPARATUS FOR CONTINUOUS PRODUCTION OF NM CABLE

[75] Inventors: James F. Holladay; R. Emory Starnes; Bobby C. Gentry; W. Carl Jones, all of Carrollton, Ga.; James O. Lowery, Ranburne, Ala.

[73] Assignee: Southwire Company, Carrollton, Ga.

[21] Appl. No.: 643,689

[22] Filed: Dec. 23, 1975

[51] Int. Cl.[2] ..... G05G 15/00

[52] U.S. Cl. ..... 156/47; 156/64; 156/361; 242/35.5 R

[58] Field of Search ..... 29/624, 527.4; 57/164; 174/116; 242/35.5 R, 35.5 A, 79; 156/47, 51, 55, 56, 158, 244, 361, 461, 468, 498, 500, 543, 60, 64, 350

[56] References Cited

U.S. PATENT DOCUMENTS

| | | | |
|---|---|---|---|
| 2,526,483 | 10/1950 | Ingmanson | 156/55 |
| 2,544,503 | 3/1951 | Kennedy | 156/55 |
| 3,487,540 | 1/1970 | Brauns et al. | 29/624 |
| 3,563,479 | 2/1971 | Brouwer et al. | 242/35.5 R |
| 3,600,500 | 8/1971 | Schoerner et al. | 174/115 |
| 3,608,293 | 9/1971 | Brouwer | 242/35.5 R |
| 3,763,554 | 10/1973 | Early | 29/624 |
| 3,852,875 | 12/1974 | McAmis et al. | 29/624 |
| 3,904,458 | 9/1975 | Wray | 156/158 |

*Primary Examiner*—David A. Simmons
*Attorney, Agent, or Firm*—Van C. Wilks; Herbert M. Hanegan; Stanley L. Tate

[57] ABSTRACT

This disclosure relates to a system for the continuous high speed production of non-metallic (NM) sheath cable from bare and insulated single strand conductors continuously produced in a high-speed tandem wire drawing and insulation operation. An automated material handling system is provided for transporting and conveying wire pack containers from coiling strands where the bare and insulated single strand wires are coiled into the containers to a station where the wires are continuously paid-out overhead from the wire pack containers and brought together in a jacketing line where PVC coating compound is extruded thereon. A sheathed cable is then coiled and packaged in a continuous manner. The depleted wire pack containers are then transported back to the coiling stands to close the material handling loop. The system is controlled by a programmable computer which controls the delivery of wire pack containers to various ones of a plurality of conveyor lines on a demand basis.

21 Claims, 4 Drawing Figures

METHOD AND APPARATUS FOR CONTINUOUS PRODUCTION OF NM CABLE

BACKGROUND OF THE INVENTION

This invention relates generally to the cable forming art, and more particularly to a method and apparatus for producing electrically conductive multi-conductor, non-metallic (NM) sheath cable from AWG 10, 12, and 14 copper and aluminum wire at speeds in excess of 750 feet per minute.

In U.S. Pat. No. 3,852,875, issued to K. W. Mc Amis and L. K. Brewton, and assigned to the assignee of this invention, there is disclosed a continuous system for the high-speed production of single strand insulated electrical wire, typically termed "T-wire." The aforementioned patent teaches a method and apparatus that is capable of producing Nos. 10, 12 and 14 AWG size plastic coated wire from 5/16 inch copper rod, and Nos. 10 and 12 AWG size plastic coated wire from $\frac{3}{8}$ inch aluminum and aluminum alloy rod, in a continuous operation at wire speeds in excess of 2500 feet per minute. The rod is drawn down into wire by combined drawing and annealing apparatus, and then conveyed directly to an in-line extruder where it is covered with the plastic coating. The coated T-wire is cooled in a three-stage system including a cooling mist, a cooling spray, and a cooling bath. The wire exiting the continuous system was then coiled and stored for further processing.

The T-wire manufactured according to the method and apparatus of the aforementioned patent is typically utilized in the manufacture of NM cable of the type disclosed in U.S. Pat. No. 3,600,500, also assigned to the assignee of this invention. Such cable includes two insulated single strand conductors, a bare ground wire having a separation film wrapped thereabout for separating the same from the insulation of the conductor wires according to UL requirements, and a non-conductive filter material for strengthening purposes. The various wires and fillers are then jacketed with a PVC compound coating composition for insulation purposes.

Heretofore, when it was desired to manufacture NM type sheath cable, conventional stem packs containing the T-wire and bare conductor wire were transported by means of fork trucks to the location in the plant where the cable jacketing lines were located and arranged in a convenient manner such that the wires could be payed-out therefrom and brought together at the beginning of the jacketing lines for entry into the PVC compound extruder. Stem packs containing the insulated T-wire were simply transported as produced in the aformentioned tandem lines and temporarily stored in a relatively random manner on the floor of the plant in the region of the jacketing lines until they could be moved into position for subsequent pay-out and jacketing.

As should be apparent, this conventional system of material handling led to several difficulties. First of all, transportation of the stem packs by means of fork trucks often damaged the stem packs as well as the wire contained therein. Moreover, such a method of transportation was time-consuming and did not lend itself to continuous, high-speed processing methods. Moreover, materials control was rendered difficult by the random on-floor storage, and much time was lost in moving and re-positioning the stem packs to gain access to the desired lot of material. Specifically, since each jacketing line, of which several would be in operation simultaneously, requires the delivery of black-insulated and white-insulated T-wire (to identify the positive and negative conductors), as well as a bare ground wire thereto, much rearrangement and repositioning of the various stem packs having the requisite material contained therein had to be accomplished in order to pay-out the proper mix of wires to each of the jacketing lines.

It should be apparent that the above-described system could not readily lend itself to continuous high-speed operation, was cumbersome and wasteful of floor space, and rendered accurate inventory of materials extremely difficult.

SUMMARY OF THE INVENTION

In view of the foregoing, it should be apparent that there is a need in the cable-forming art for an improved system for production of NM sheath cable that overcomes the disadvantages inherent in the prior art system of production. Accordingly, it is the primary object of this invention to provide an automated system for the production of NM sheath cable that facilitates continuous, high-speed, in-line processing of a sheathed multi-strand cable from continuously processed insulated and bare single-strand wire.

Another object of this invention is to discard the "mini-systems" approach of the prior art to the production of NM cable, and provide a method and apparatus which consolidates into an integrated system the individual components of the system to eliminate inefficient material movement and excessive product damage, while at the same time producing a finished product of superior quality.

More particularly, it is an object of this invention to provide a system that eliminates the necessity of transporting loaded stem packs of wire on fork trucks, and which instead automatically moves wire pack containers on a novel conveyor system from coiling strands to wire-payoff stations and jacketing lines.

A further object of this invention is to provide an automated system that operates on a demand basis by transporting wire pack containers from coiling stands to a plurality of conveyor lines which convey the containers to pay-out stations, while continuously monitoring the supply of containers on the various conveyors and delivering subsequent containers to the various conveyor lines as needed.

Another object of this invention is to provide a closed-loop conveyor system for transporting wire pack containers from coiling stands to pay-out stations, and which returns empty containers to the coiling stands for subsequent refilling.

Yet another object of this invention is to provide a method and apparatus for increasing production speeds of NM cable and eliminating inefficient material handling and excessive product damage.

Briefly described, these and other objects of the invention that may become hereinafter apparent are accomplished in accordance with this invention by providing a novel material handling system for transporting wire pack containers from the coiling strands of the tandem lines described in the aforementioned U.S. Pat. No. 3,852,875, as well as wire packs of bare wire received from other coiling stands, to jacketing lines where the wires are brought together and a PVC insulation coating is applied thereto.

Included in this system is a network of accumulation conveyors and transfer cars which run between the conveyors and upon which the wire pack containers are automatically transported from station to station. When loaded at the coiling stands, the containers are routed over a series of parallel conveyor lanes, across a variety of paths. In a preferred embodiment of the invention, which will be described in more detail hereinafter, automated transfer cars in three separate aisles work at right angles to the direction of flow. The transfer cars perform all between-lane transfers. The first transfer car moves containers from the coiling stands of three tandem lines (as described in the aforementioned U.S. Pat. No. 3,852,875) to any one of three accumulation lines, or to either one of two reversible overflow lines.

A second transfer car receives containers from the output ends of the five aforementioned lines, or from a line leading from a bare wire coiling stand. This transfer car delivers the containers to any one of ten accumulation storage lines, or to any one of three overflow lines.

The third transfer car works across the discharge ends of the ten accumulation lines. Its function is twofold: After the coiled wire is paid-out from the containers overhead to the respective jacketing lines, the car moves empty containers to a main return line which links up with the coiling stands. In addition, this transfer car feeds loaded containers to three additional lanes which supply braiding machines in a separate production operation.

Control of the system is by a programmable controller. The program is contained on a magnetic tape cassette, and can be altered simply by replacing one cassette for another. Instructions for the routing of the loaded containers from each coiling stand are set up through a push-button keyboard on a master control panel. Command signals are sent from the programmable controller directly to each transfer car. Firstly, a car is directed to the proper pick-up lane, and the container is then loaded automatically thereon. Then, the transfer car moves to the predetermined outbound lane and the container is off-loaded.

Each conveyor lane has limit switches which tells the programmable controller when a wire pack container has reached the end of a lane. The limit switches also serve to detect when a lane is full. If an accumulation lane is full, the transfer car places the wire pack container in one of the overflow lanes. The overflow lanes are reversible such that the material can be retrieved when needed.

The accumulation conveyers are made up of gravity rollers to support the wire pack containers. A drive chain is mounted between the rollers. Contact between chain and load is maintained by an inflatable tube. The forward driving force is provided by friction. As the containers accumulate within a lane, weight depresses the inflatable tube, thus allowing the chain to slide beneath the load without pressure build-up.

After the wire is payed-out of the containers at the jacketing lines, the third transfer car receives a signal from the controller to pick up the empty. The empty container is then returned to the coiling stands for filling, thus completing the cycle.

With the above and other objects in view that may become hereinafter apparent, the nature of the invention may become more clearly understood by reference to the several views illustrated in the attached drawings, the following detailed description thereof, and the appended claimed subject matter. In the drawings:

Figure 4:
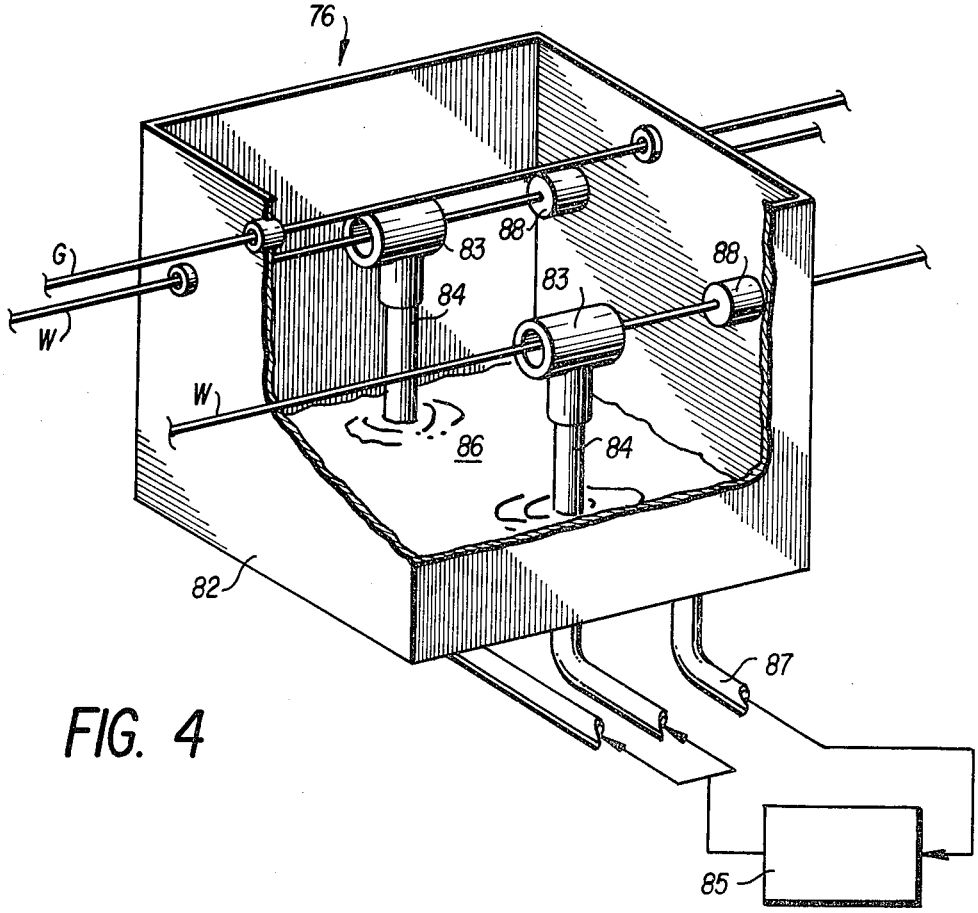
Figure 3:
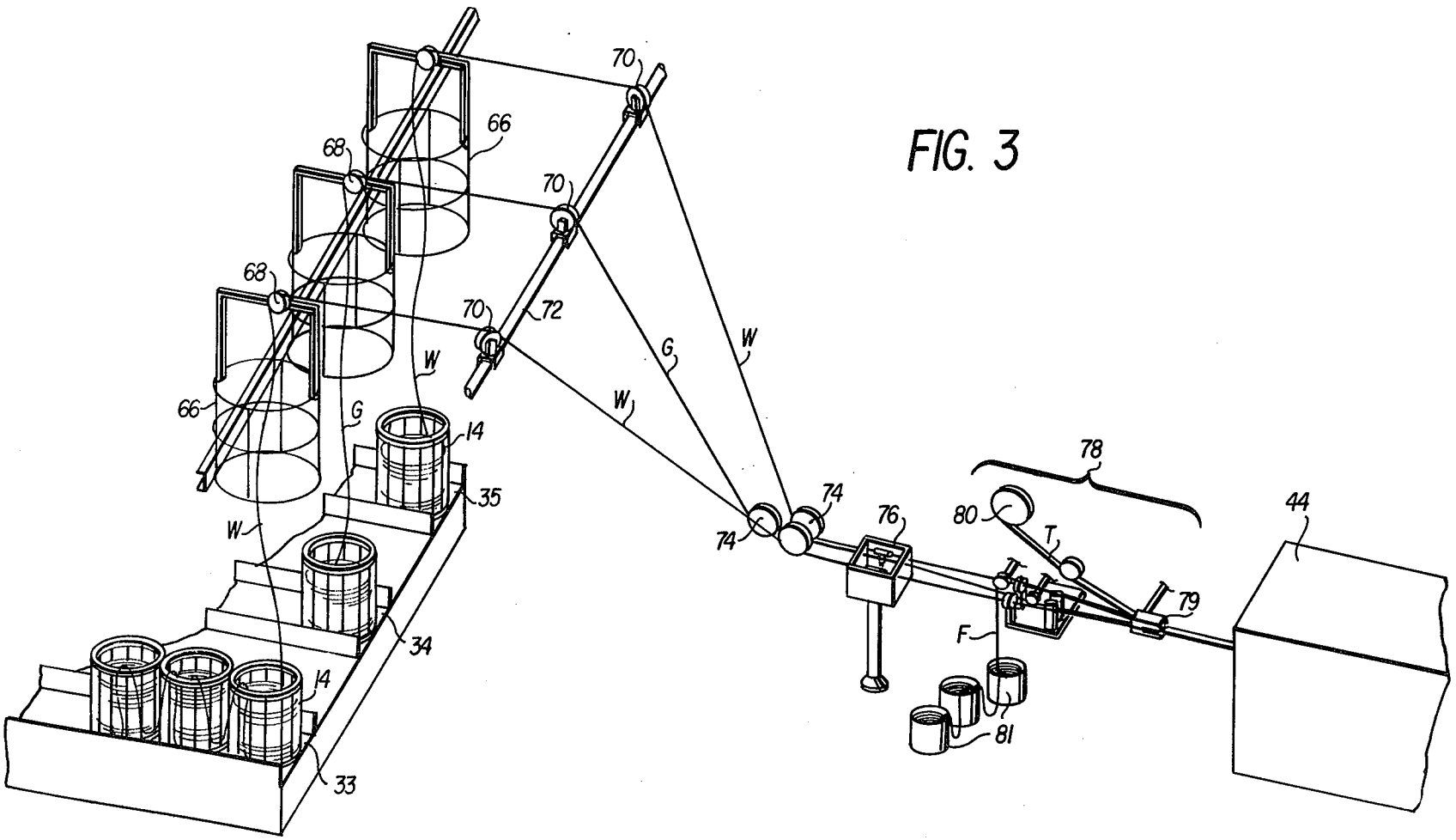

FIG. 3 is perspective view of a wire pay-out station, and illustrates wires being withdrawn overhead from three stemless wire pack containers and then brought together and fed into a jacketing line for the application of an NM sheath thereabout, and further illustrates a guide block which serves as a means for folding a separation tape about the bare ground wire for separating the same from the two insulated T-wires; and FIG. 4 is an enlarged perspective view of a release agent tank which is used to apply a release agent to the two insulated T-wires prior to coming into contact with the separation tape, portions thereof being cut away for clarity to illustrate details thereof, and further illustrates schematically a recycle and pump apparatus for the device.

DETAILED DESCRIPTION OF PREFERRED EMBODIMENT

Figure 1:
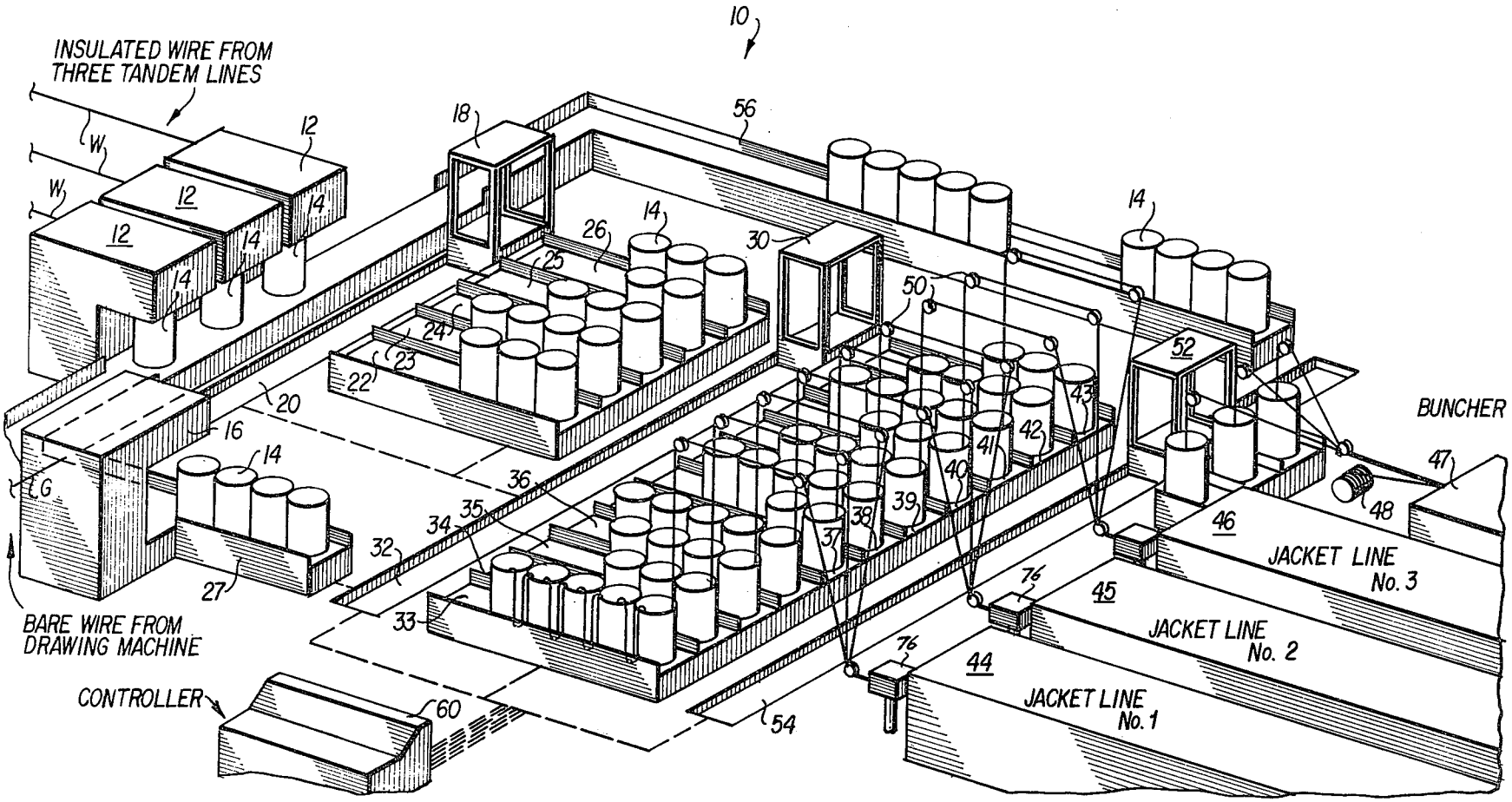
FIG. 1 is a schematic perspective view of the material handling system of this invention, and illustrates a plurality of conveyor lanes and transfer cars, operating perpendicularly thereto, for transporting wire pack containers from coiling stands to pay-out stations where the wires are fed into any one of three jacketing lines or a buncher line.

Referring now to the drawings in detail, there is illustrated in FIG. 1 a material handling system, generally designated by the numeral 10, for facilitating continuous production of NM sheath cable in accordance with this invention. Insulated T-wire W enters the system 10 from three tandem lines (not shown) of the type disclosed in the aforementioned U.S. Pat. No. 3,852,875. The T-wire W is a plastic coated number 10, 12 or 14 AWG size copper, aluminum or aluminum alloy wire which is capable of being produced in accordance with the method of the aforementioned patent at speeds in excess of 2500 feet per minute. The plastic insulation of the T-wire W is color coded, preferably in white, black and red, for subsequent identification in the production of NM sheat cable. The particular color coding can be selected by varying the dye which is added to the PVC compound in the extrusion dies of tandem lines of the aforementioned U.S. Pat. No. 3,852,875.

The T-wire W enters conventional coiling apparatus 12 by means of which it is coiled in successive convolutions or loops into wire pack containers 14, preferably of a type disclosed in copending application Ser. No. 643,917 filed Dec. 23, 1975, also assigned to the assignee of this invention.

Bare wire G, used as a ground wire in the NM cable, enters the system 10 at a conventional coiling stand 16 and is continuously loaded into containers 14 in the same manner as the T-wire W. The bare wire G preferably emits continuously from a wire drawing machine, either in the hard-drawn or annealed condition, depending on the desired characteristics of the wire.

Loaded wire pack containers 14 are picked up at the coiling strands 12 by a first transfer car 18 movable on a track 20. The containers 14 are automatically loaded onto the car 18 and transported along the track 20 to any one of three accumulation conveyors 22, 23 and 24, or to either one of two overflow conveyor lanes 25, 26. The conveyors 22–24 are movable from left to right, as seen in FIG. 1, while the overflow conveyor lanes 25 and 26 are movable in both directions so that containers 14 disposed thereon could be retrieved from either end of the conveyor lane. When the transfer car 18 reaches the front end of the desired conveyor lane, which lane is predetermined in a manner to be hereinafter described, the container 14 is off-loaded and conveyed down the lane to its downstream end. If any of the accumulation lanes 22–24 are full, the transfer car 18 will be directed to either one of the overflow lanes 25, 26 and the container 14 off-loaded thereon for temporary storage until there is room therefor on one of the accumulation lanes 22–24.

Containers 14, loaded with bare wire G at the coiling stand 16 are accumulated on a conveyor lane 27. Wire pack containers 14 disposed at the ends of any of the conveyor lanes 22–27 may be picked up by a second transfer car 30 which is movable on a track 32 running perpendicular to the conveyor lanes 22–27. The tranfer car 30 can be directed, in a manner to be hereinafter described, to pick up containers 14 disposed at the ends of any of the conveyor lanes 22–27 and transport the same to any one of a plurality of accumulation conveyors 33–41, or to either one of overflow conveyor lanes 42, 43. The containers 14 are automatically off loaded from the transfer car 30 onto any one of the conveyor lanes 33–43 in the same manner that the containers 14 are off-loaded from the first transfer car 18. The containers 14 are conveyed down the accumulation conveyors 33–41 to the downstream ends thereof which comprise pay-out stations for subsequent processing. The overflow lanes 42, 43 are movable in both directions so that containers 14 may be retrieved therefrom by the transfer car 30 and transported to any one of the accumulation conveyors 33–41 on a demand basis as will be described more fully hereinafter.

The system 10 further includes three jacketing lines 44, 45 and 46, as well as a buncher line 47 into which the T-wire W and the bare wire G is payed-out from the respective wire pack containers 14 for the manufacture of cable. The jacketing lines 44–46 are designed to manufacture NM sheath cable, while the buncher 47 is designed to manufacture a non-insulated stranded cable.

Each jacketing line 44–46 has two T-wires W and one bare wire G delivered thereto. The T-wires comprise the positive and negative conductors, each covered with a different color plastic coating, and the bare wire G comprises the ground wire for the cable. For purposes of illustration, one of the two T-wires W will be described herein as having a white insulation, while the other T-wire W will be described as having a black insulation.

The buncher 47 is intended to produce a stranded cable having three T-wires W and one bare ground wire G. The three T-wires have different colored insulation codings, for example black, white and red, and are supplied from containers 14 delivered from the coiling strands 12. On the other hand, the bare wire G is supplied from a separate reel 48 which may be rotatably mounted about a horizontal axis.

In view of the foregoing, it should be apparent that the proper mix of wires must be delivered to each of the jacketing lines 44–46 and the buncher line 47. The mix must be proper as the number of insulated T-wire W conductors, the bare ground wire G, and the appropriate color coding on the T-wires W. With regard to the first jacketing line 44, two T-wires W and one bare ground wire G is delivered thereto from containers 14 disposed at the ends of the first three accumulation conveyors 33–35. The second jacketing line 45 has the same mix of wire delivered thereto from the next group of containers 14 disposed at the ends of the accumulation lanes 36–38. Similarly, the third jacketing line has two T-wires W and one ground wire G delivered thereto from the third group of containers 14 disposed at the ends of the accumulation lanes 39–41. The wire payed-out from each of the containers 14 is withdrawn overhead about appropriately positioned sheaves 50 in a manner to be more fully described hereinafter.

In view of the foregoing, it should be apparent that only containers 14 having a specified product disposed therein should be delivered to each of the accumulation conveyors 33–41. For example, as to the first group of conveyors, 33–35, the conveyor 33 should have only bare wire G delivered thereto, the conveyor 34 should have only white-insulated T-wire W delivered thereto and the conveyor 35 should have only black-insulated T-wire W delivered thereto. Accordingly, the proper mix of wires will be delivered to the jacketing line 44. The same mix or blend of wires will be apportioned among the remaining accumulation conveyors 36–41.

In order to automatically accomplish the foregoing, and to deliver an appropriate wire-pack container 14 to the appropriate conveyor lane 33–41 as needed on a demand basis, a programmable controller 60 is provided. The programmable controller 60 is appropriately connected to each of the transfer cars 18 and 30 through their respective tracks 20, 32, as well as to the various conveyor lanes 22–27 and 33–43. The controller 60 is adapted to monitor the supply of containers 14 disposed on any one of the conveyors, and to direct the transfer cars 18 and 30 to transport a container 14, loaded with the appropriate type of material, to the appropriate conveyor lane on a demand basis. Each conveyor includes limit switches (not shown) which tell the programmable controller 60 when a container 14 has reached the end of a lane, and which also function to detect when a lane is full. The routing of the containers 14 across the various lanes is a function of the program supplied to the controller 60. By changing the program, the mix or blend of the wires supplied to any of the jacketing lines 44–46 or the buncher line 47 can be varied. Alternatively, the controller 60 can be manually controlled to direct the transfer cars 18 and 30 to any of the conveyor lanes as described by the operator.

When a container 14 disposed at the ends of any of the conveyor lanes 33–41, or disposed at the buncher line 47, has been depleted, the controller 60 sends a signal to a third transfer car 52 which moves along a track 54 disposed perpendicular to the conveyor lanes 33–43. The transfer car 52 is directed to pick up the empty container 14 and transport the same to a return conveyor 56 which transports the empty containers 14 back to the coiling stands 12 and 16 for subsequent refilling. The third transfer car 52 is also adapted to transport full containers 14 from any of the accumulation lanes 33–41, or from either of the two overflow lanes 42, 43, to the buncher line 47 for processing therein.

Turning now to FIG. 3, there is illustrated apparatus for withdrawing wire from a group of pay-out stations, disposed at the ends of three conveyor lanes, and delivering the same to a jacketing line for the application of a NM sheath thereabout. For illustration purposes, the first three accumulation conveyors 33–35 have been depicted along with the first jacketing line 44. The two T-wires W and the one bare ground wire G are withdrawn overhead from their respective wire pack containers 14 through guide cages 66 having guide sheaves 68 mounted thereon. The wires are then guided over pulleys 70 mounted on a transverse support beam 72, then downwardly around guide pulleys 74, through a release agent tank 76 (to be described more fully hereinafter), through a tape guiding and folding apparatus, generally designated by the numeral 78, and then into the jacketing line 44.

The tape guiding and folding apparatus 78 includes a tape folder 79 which folds a polyester tape T, supplied from a supply reel 80, about the ground wire G to separate the same from the insulation of the two T-wires W. Additionally, in accordance with the aforementioned U.S. Pat. No. 3,600,500, a filler and strengthener F, supplied from appropriate containers 81, is delivered into the tape folder 79 and the tape T is additionally wrapped thereabout along with the gound wire G.

Prior to coming into contact with the tape T, however, the T-wires W are caused to pass through the release agent tank 76 wherein a release agent is applied thereto. As seen most clearly in FIG. 4, the release agent tank 76 includes a box-like housing 82 having two T-connection jet pumps 83 disposed therein. The jet pumps 83 are connected by means of pipes 84 to a source of liquid release agent supply 85 which includes pump means for maintaining continuous recirculation of the liquid release agent 86. The release agent 86 is returned to the source 85 through a drain pipe 87.

The T-wires W pass through the pumps 83 in which the release agent 86 is sprayed thereon. The T-wires W then pass through wipers 88 mounted in the wall of the housing 82 for wiping excess release agent 86 therefrom. Since the ground wire G need not be provided with the release agent 86, it simply by-passed through the release agent tank 76.

Referring again to FIGS. 1 and 3, it can be seen that the wire contained in the containers 14 disposed at the pay-out stations of the accumulation conveyors 33, 41 are "pigtailed" such that the trailing end of the wire contained in each container is connected to the leading end of the wire in the next subsequent upstream container. Consequently, the wire may be continuously payed-out therefrom without stopping the continuous operation, and the conveyor lanes simply energized to move the filled containers 14 down to the pay-out station upon the depletion and removal of an empty container 14 by the third transfer car 52.

Figure 2:
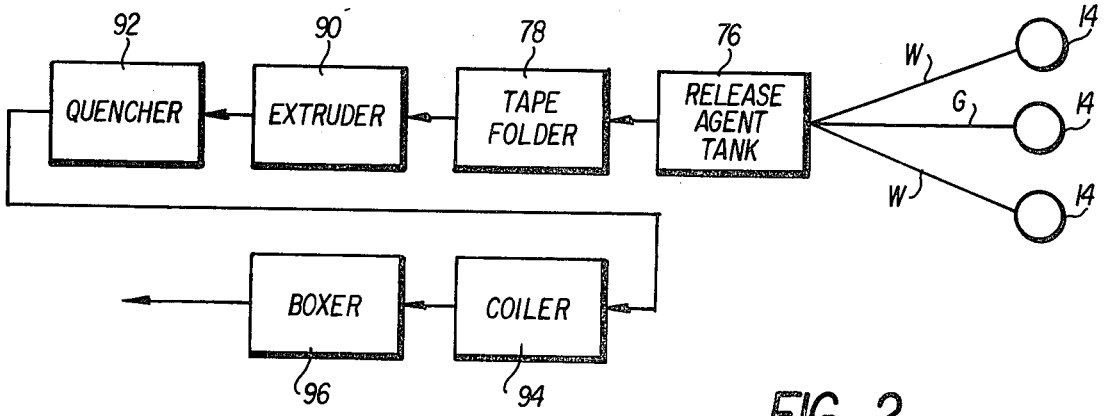
FIG. 2 is a schematic block diagram of a jacketing line into which three wires (two insulated and one bare) are brought together and covered with a NM sheath jacket, then continuously coiled in predetermined lengths and boxed.

Referring now to FIG. 2, there is schematically illustrated in block diagram form the various steps performed in each of the jacketing lines wherein there is produced NM sheath cable, preferably coiled into predetermined lengths and automatically boxed. As previously described, the two T-wires W and one ground wire G pass through the release agent tanks 76 and then into the tape folder 79 wherein the polyester tape T is folded about the ground wire G and the filler F. The tape folder 79 is preferably of the type shown in U.S. Pat. No. Des. 230,504, assigned to the assignee of this invention. After exiting the tape foler 79, the various wires, fillers and tape enter the die of an extruder 90 wherein they are jacketed with a PVC coating compound. The extruder is preferably a 20/1/L/D thermatic extruder of the type disclosed in the aforementioned U.S. Pat. No. 3,852,875. The extruder includes a hopper (not shown) into which the coating compound formulation is admitted in the form of a dry, homogeneous pellet. The compound is preferably a polyvinyl chloride based resin including platicizers, fillers and lubricant stabilizers. The compound is preheated the hopper and is maintained at a temperature of approximately 225° F from where it is admitted into a pressure chamber where it is advanced by means of a screw toward the extruder die. The melt temperature is increased in the die of the extruder and maintained automatically by a commercially available temperature control unit, such as that sold by the Barber-Colman Company. The melt, as it is applied to the wires, is maintained between 360° and 380° F.

After exiting the extruder 90, the coated wires enter a quencher apparatus 92 where a cooling fluid is applied thereto for setting the insulation coating.

After exiting the quencher 92 the NM sheath cable is continuously coiled into predetermined lengths in a coiler 94 and the predetermined lengths of coil are then automatically boxed in a boxer 96. The boxer/coiler 94–96 is preferably of the type disclosed in copending application Ser. No. 643,921 filed Dec. 23, 1975 and assigned to the assignee of this invention.

In view of the foregoing, it should be apparent that there is provided in accordance with this invention, an integrated system for the continuous production of NM sheath cable which continuously and automatically conveys, pays-off, extrudes, winds and packages the finished product. The system takes bare and insulated single strand conductors and processes the same into an NM sheath cable which is finished industry standard packaged all in a matter of seconds. The unique interlocking of process equipment in accordance with this invention has closed the gap in producing continuously, in-line and automatically wire rod to a final packaged NM product.

Although only a preferred embodiment of the invention has been specifically illustrated and described herein, it is to be understood that minor modifications could be made therein without departing from the spirit and scope of the invention as defined in the appended claims.

What is claimed is:

1. System for continuous production of insulated multi-strand electrical cable comprising;

a. a first station having means for coiling insulated single strand conductor wires in a plurality of wire pack containers;

b. a second station having means for coiling bare ground wire in a plurality of wire pack containers;

c. means for transporting said containers to selected ones of a plurality of conveyor paths adapted to convey said containers to a plurality of third stations, the wire in each of said containers having a leading end and a trailing end, said conveyor paths including accumulation conveyors adapted to accumulate a plurality of said containers in tandem array so as to facilitate connecting the trailing ends of wires in each of said containers with the leading ends of wires in the following containers;

d. programmable controller means for operating said system in accordance with a predetermined program;

e. means for monitoring the supply of containers on each of said conveyor paths;

f. means responsive to said monitoring means and operatively connected to said programmable controller means for transmitting information to said programmable controller means;

g. said programmable controller means including means for processing the information transmitted from said monitoring means and for generating signals to said transporting means to deliver selected ones of said types of electrical conductor wires to selected ones of said third stations in accordance with said predetermined program;

h. means for paying-out wire from said containers located at said third stations, including means for bringing together two insulated wires and one bare wire from their respective containers;

i. means for automatically removing depleted ones of said containers from said conveyor paths and for advancing the next container to said respective third station for continuous paying of wire therefrom;

j. means for continuously jacketing wire payed-out of said containers; and k. a return conveyor line for conveying depleted ones of said containers from said third stations back to the first and second stations.

2. System as defined in claim 1, including a plurality of said jacketing means, and a group of three conveyor paths, each terminating in a third station provided for each of said jacketing means.

3. System as defined in claim 2, further including automatic means for controlling said transporting means to transfer containers having insulated wire coiled therein to two of said three conveyor paths and bare wire to the third of said three conveyor paths in each of said groups.

4. System as defined in claim 1, wherein said jacketing means includes means for extruding a continuous insulation jacket about a plurality of wires passed therethrough, means for passing two insulated wires and one bare wire, payed-out of their respective containers, through said extruding means to provide an insulation jacket thereon and thus form an insulated multistrand cable, means for cooling the insulated cable, and means for continuously coiling and packaging the insulated cable.

5. System as defined in claim 1 wherein said means for paying-out wire includes means for withdrawing said wire from said containers to guides means disposed above said containers at said third stations.

6. System as defined in claim 1, wherein said conveyor paths include at least one overflow conveyor for temporarily storing containers of wire prior to being transported to said accumulation conveyors.

7. System as defined in claim 1, wherein said transporting means includes a transfer car movable in a path extending perpendicular to said conveyor paths and adapted to deliver containers from said first and second stations to any one of said conveyor paths.

8. System as defined in claim 1, wherein said means for bringing together includes a guide block disposed in front of said jacketing means, said block including means for guiding two insulated wires and one bare wire therethrough, means for continuously supplying a separation tape to said guide block, and wherein said guide block includes means for folding said tape about said bare wire to separate the same from insulated wires prior to running into said jacketing means.

9. System as defined in claim 8, further including means for applying a release agent to said insulated wires prior to coming into contact with said separation tape.

10. Method of handling electrical conductor wires in a continuous system for the production of multi-strand electrical cable comprising:

a. coiling a plurality of types of electrical conductor wires in respective wire pack containers;

b. transporting said containers to a plurality of processing stations along a plurality of conveyor paths;

c. monitoring the supply of containers on each of said conveyor paths;

d. transmitting information to a programmable controller as a function of the supply of containers monitored on said conveyor paths; and e. processing the information transmitted to the programmable controller and generating signals to deliver selected ones of said types of electrical conductor wires to selected ones of said processing stations in accordance with a predetermined program.

11. Method as defined in claim 10, wherein said coiling step includes moving empty wire pack containers to first and second stations and loading insulated single strand conductor wire and bare ground wire therein at the respective stations, and further including the steps of:

a. conveying the loaded containers down the conveyor paths to the processing stations while accumulating loaded containers on the paths upstream of the processing stations in a ready condition;

b. paying-out wire from the containers at the processing stations and continuously applying an insulating coating compound thereto; and c. continuously replacing depleted containers at the processing stations by automatically advancing the next accumulated ready container to the end of the respective conveyor line thereby permitting the continuous paying-out and insulating operations.

12. Method as defined in claim 11, further including the step of:

a. returning depleted containers from said third stations to said first and second stations.

13. Method as defined in claim 11, wherein the wire of each of said loaded containers has a leading end and a trailing end, said step of accumulating includes connecting the trailing end of the wire disposed in a container at said processing station with the leading end of the wire contained in the next upstream container, and conveying said next upstream container downstream to said processing station upon the depletion of the preceding container.

14. Method as defined in claim 11, wherein said step of paying-out includes bringing together two insulated wires and one bare wire, and passing said wires through an extruder to apply said insulating coating compound thereto.

15. Method as defined in claim 11, further including the steps of automatically determining which of said conveyor lines requires the delivery of additional loaded containers, and discriminating whether an insulated or bare wire container should be delivered thereto.

16. Apparatus for handling electrical conductor wires in a continuous system for the production of multistrand electrical cable comprising:

a. means for coiling a plurality of types of electrical conductor wires in respective wire pack containers;

b. means for transporting said containers to a plurality of processing stations along a plurality of conveyor paths;

c. programmable controller means for operating said system in accordance with a predetermined program;

d. means for monitoring the supply of containers on each of said conveyor paths;

e. means responsive to said monitoring means and operatively connected to said programmable controller means for transmitting information to said programmable controller means; and f. wherein said programmable controller means includes means for processing the information transmitted from said monitoring means and for generating signals to said transporting means to deliver selected ones of said types of electrical conductor wires to selected ones of said processing stations in accordance with said predetermined program.

17. Apparatus as defined in claim 16, wherein said conveyor paths are arranged in parallel and extend from said coiling means to said processing stations, and wherein each of said containers is delivered to a selected one of said parallel conveyor paths which is predetermined by said programmable controller means.

18. Apparatus as defined in claim 16, each of said processing stations including three pay-out locations disposed at the ends of three parallel conveyor paths, means for withdrawing wire from said containers at said pay-out locations, and wherein said controller means is programmed to control said transporting means to deliver containers of insulated wire to two of said three conveyor paths and bare ground wire to the third of said three conveyor paths.

19. Apparatus as defined in claim 18, wherein said conveyor paths comprise accumulation conveyors adapted to accumulate a plurality of said contaners in tandem array with the trailing ends of the wires in each of said containers connected to the leading ends of the wires in the successive containers, and means for automatically removing a depleted container from said pay-out location and advancing the next container to the end of said conveyor path, thereby permitting continuous paying-out of wire therefrom.

20. Apparatus as defined in claim 17, further including at least one overflow conveyor path for temporarily storing said containers of wire prior to being delivered to a selected one of said paths extending to said processing stations.

21. Apparatus as defined in claim 17, said transporting means including means movable perpendicular to said parallel conveyor paths for on-loading containers of wire onto said conveyor paths and for off-loading depleted containers at said processing stations.

* * * * *